US006837527B1

(12) United States Patent
Laurenzana

(10) Patent No.: US 6,837,527 B1
(45) Date of Patent: Jan. 4, 2005

(54) STRIKE PLATE ASSEMBLY FOR A DEAD BOLT

(76) Inventor: Michael T. Laurenzana, 223 Elm St., Kincaid, IL (US) 62540

( * ) Notice: Subject to any disclaimer, the term of this patent is extended or adjusted under 35 U.S.C. 154(b) by 0 days.

(21) Appl. No.: 10/657,001

(22) Filed: Sep. 8, 2003

(51) Int. Cl.[7] ..... E05B 15/02
(52) U.S. Cl. ..... 292/340; 292/346; 52/204.1
(58) Field of Search ..... 292/340, 341, 292/341.14, 346, DIG. 2, 1; 52/204.1, 211, 212, 215

(56) References Cited

U.S. PATENT DOCUMENTS

| | | | | | |
|---|---|---|---|---|---|
| 587,131 | A | * | 7/1897 | Markert | 292/140 |
| 48,958 | A | | 4/1916 | Young | |
| 2,255,860 | A | * | 9/1941 | Riedel | 292/340 |
| 2,272,241 | A | * | 2/1942 | Fendring | 292/340 |
| 2,370,781 | A | | 3/1945 | Cullum | |
| 3,095,021 | A | | 6/1963 | Schlage et al. | |
| 3,107,934 | A | * | 10/1963 | Royal | 292/150 |
| 3,152,825 | A | * | 10/1964 | Schlage | 292/340 |
| 3,888,530 | A | * | 6/1975 | Fabrici | 292/340 |
| 4,057,275 | A | | 11/1977 | La Beaud | |
| 4,065,162 | A | | 12/1977 | Schlage | |
| 4,171,837 | A | * | 10/1979 | McRoy | 292/346 |
| 4,186,954 | A | | 2/1980 | Detlefs | |
| 4,211,442 | A | * | 7/1980 | Hansen | 292/340 |
| 4,458,931 | A | * | 7/1984 | McBurnie | 292/346 |
| 4,522,048 | A | * | 6/1985 | Davis | 70/417 |
| 4,550,939 | A | * | 11/1985 | Babb et al. | 292/340 |
| 4,832,386 | A | * | 5/1989 | Sweet | 292/264 |
| 5,344,198 | A | * | 9/1994 | Elliott | 292/340 |
| 5,640,808 | A | * | 6/1997 | Simeone et al. | 49/504 |
| 5,769,473 | A | * | 6/1998 | Sovis | 292/340 |
| 6,612,629 | B2 | * | 9/2003 | O'Hanlon | 292/346 |
| 6,651,390 | B2 | * | 11/2003 | Camperelli | 49/504 |

FOREIGN PATENT DOCUMENTS

DE 32 02 253 A1 * 1/1982 ..... E05B/15/02

OTHER PUBLICATIONS

Title of Source: www.magsecurity.com Product Name: Guard–It Reinforcing Kit For Deadbolts.

* cited by examiner

*Primary Examiner*—Gary Estremsky

(57) ABSTRACT

A dead bolt strike plate assembly includes a steel reinforcement plate and a steel receiving plate including a cylindrical aperture formed therein for receiving a dead bolt therethrough. The receiving plate includes a plurality of holes formed about the cylindrical aperture for receiving conventional wood screws therein and for being secured to a door jamb. The assembly further includes a steel barrel portion with a substantially cylindrical hollow interior integral with the receiving plate for receiving a dead bolt therein. The barrel portion extends perpendicularly and rearwardly from the receiving plate into an opening formed in the door jamb and a supporting wall stud. The barrel portion is secured to the wall stud using a conventional wood screw inserted through an opening disposed at a rear portion of the barrel portion.

18 Claims, 2 Drawing Sheets

STRIKE PLATE ASSEMBLY FOR A DEAD BOLT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

TECHNICAL FIELD

This invention relates generally to strike plates for dead bolts and, more particularly, to a steel-reinforced strike plate for dead bolts in wooden door jambs.

PRIOR ART

Although a dead bolt lock offers additional security when compared to or used in conjunction with a conventional door lock, the fact that the dead bolt is often mounted to a wooden door jamb, especially in residential construction, leaves it vulnerable to breach. A wooden door jamb provides a hollow space in which a latch bolt of a door can be engaged to lock the door against opening. The hollow space is close to an edge of the jamb leaving only a thin layer of wood to break away in order to force entry. A strike plate mounted around the hollow space and fastened by screws adjacent thereto further weakens the jamb. Often a shoulder thrust or a hard kick is usually sufficient to break the jamb and open the door.

Any door framed with wood can ultimately be breached using basic homeowner's tools found in almost any garage regardless of the type of lock installed if the perpetrator has enough time. Hence, the old adage that "locks only keep honest people out." The key to reinforcing such doors is to provide a strong enough assembly so that someone who is attempting to forcefully enter will not have enough time to subvert the reinforcement and still quietly avoid detection. Such a reinforcement is preferably made of steel as opposed to a softer metal like brass or aluminum, and designed for ease of installation into new and existing construction without modification of the standard design of the doors commonly used in construction today. Unfortunately, prior art attempts have multiple shortcomings, which are susceptible to the above-noted problems.

Accordingly, a need remains for a steel, tamper proof dead bolt strike plate that can be easily installed into both new and existing doorways without modifying the design thereof.

BRIEF SUMMARY OF THE INVENTION

In view of the foregoing background, it is therefore an object of the present invention to provide an assembly for reinforcing wooden door jambs to make them tamper proof. These and other objects, features, and advantages of the invention are provided by a dead bolt strike plate assembly that includes an elongated reinforcement plate having a longitudinal axis and a plurality of opposed edge portions equally spaced from the longitudinal axis and extending substantially parallel thereto and along a length of the plate.

The reinforcement plate has a plurality of holes disposed at opposed end portions thereof that receive a plurality of fastening members therethrough so that the reinforcement plate can be secured to a first face of a wall stud.

The strike plate assembly further includes a receiving plate formed from steel and spaced from the reinforcement plate. Such a receiving plate has a substantially cylindrical aperture formed therein for receiving a dead bolt therethrough. The receiving plate has a plurality of holes formed about the cylindrical aperture for receiving a plurality of fastening members therethrough to secure the receiving plate to a door jamb notch. The receiving plate also includes front and rear surfaces, with the rear surface being engageable with a door jamb notch and integral with the barrel portion. The receiving plate further includes opposed end portions, between which the cylindrical aperture and the barrel portion are disposed substantially medially.

The strike plate assembly further includes a barrel portion formed from steel and having a substantially cylindrical hollow interior, which is integral with the receiving plate. Such a barrel portion extends substantially perpendicularly and rearwardly from the receiving plate so that same can be inserted into an opening of a door jamb and into an opening formed on a second face of a wall stud. The barrel portion receives a dead bolt therein and assists to maintain same in a stable position during operating conditions. Advantageously, the steel barrel portion prevents a would-be thief from prying the dead bolt apart from the strike plate and door jamb.

The barrel portion is spaced from the reinforcement plate and has a longitudinal axis extending substantially perpendicularly to the longitudinal axis of the reinforcement plate. The barrel portion further includes a rear end portion having an opening therein and for receiving a fastening member therethrough to secure the barrel portion to a wall stud.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
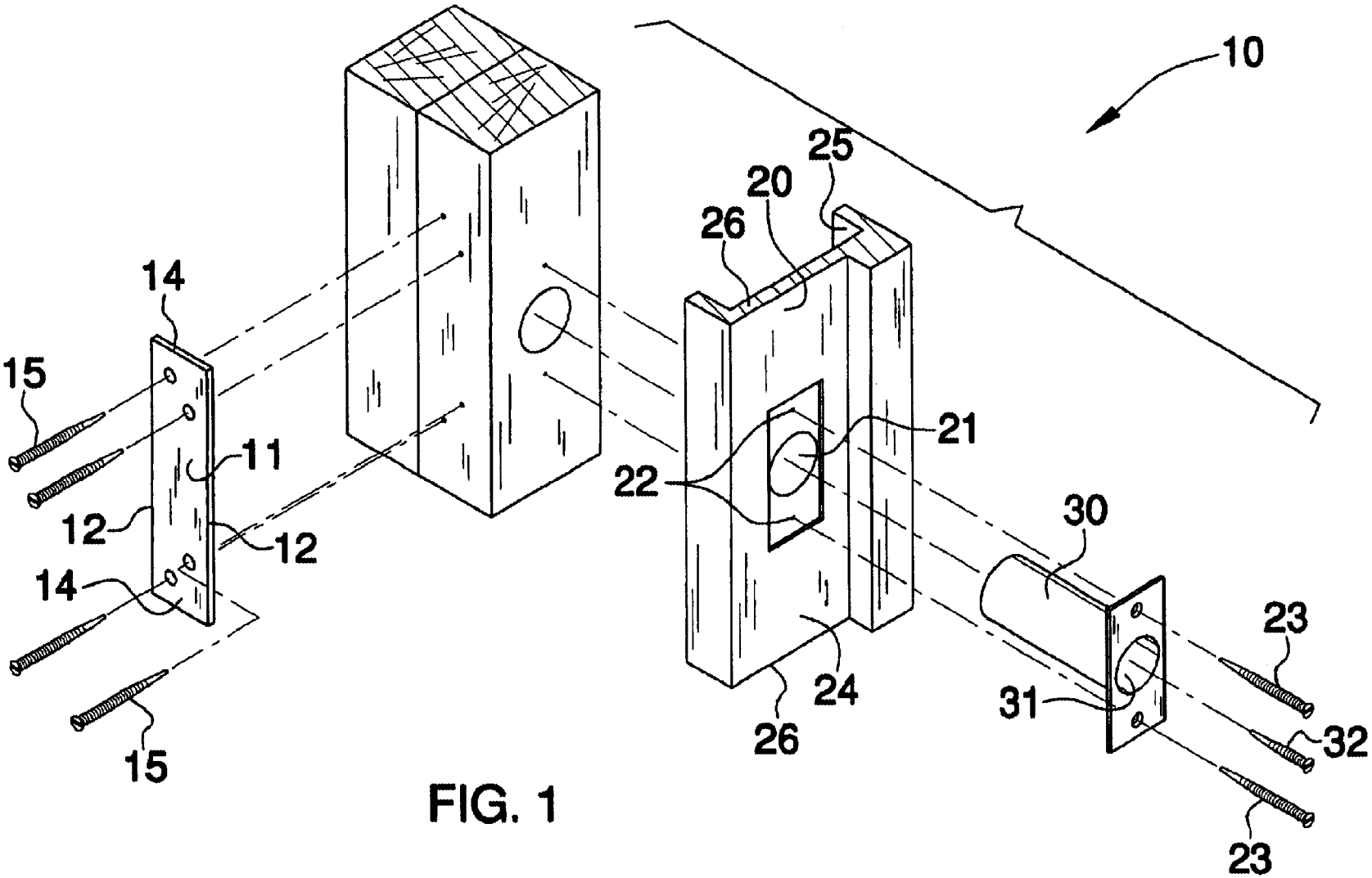
FIG. 1 is an exploded view showing a strike plate assembly for a dead bolt, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art The assembly of this invention is referred to generally in FIGS. 1–4 by the reference numeral 10 and is intended provide a tamper proof reinforced dead bolt strike place assembly to prevent unauthorized entry into a building or home. It should be understood that the assembly 10 may be used to reinforce many different types of strike plates and locks and should not be limited to only dead bolts.

Initially referring to FIG. 1, the strike plate assembly 10 includes an elongated reinforcement plate 11 preferably formed from steel. Such a plate 11 has a longitudinal axis and a plurality of opposed edge portions 12 equally spaced from the longitudinal axis and extending substantially parallel thereto and along a length of the reinforcement plate 11. The reinforcement plate 11 further has a plurality of holes 13 disposed at opposed end portions 14 thereof to receive a plurality of fastening members 15 therethrough, such as conventional wood screws well known to a person of ordinary skill in the art, so that the reinforcement plate 11 can be secured to a first face of a wall stud. Although the installation of this reinforcement plate 11 is optional, it adds additional strength to the wall stud and helps prevents someone from prying apart the dead bolt from the doorjamb.

Still referring to FIG. 1, the strike plate assembly 10 further includes a receiving plate 20 preferably formed from steel and spaced from the reinforcement plate 11. The receiving plate 20 has a substantially cylindrical aperture 21 formed therein for receiving a dead bolt therethrough. The receiving plate 20 further has a plurality of holes 22 formed about the cylindrical aperture 21 for receiving a plurality of fastening members 23 therethrough, such as conventional wood screws, for securing the receiving plate 20 to a door jamb notch, as perhaps best shown in FIG. 4.

Figure 3:
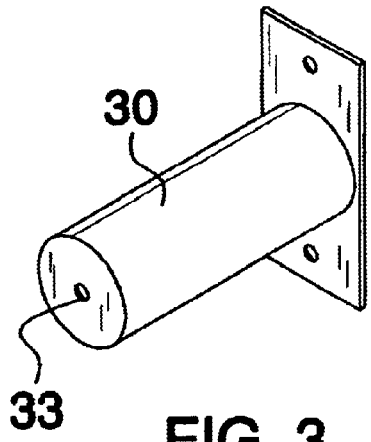
FIG. 3 is a perspective view of the barrel portion.
Figure 4:
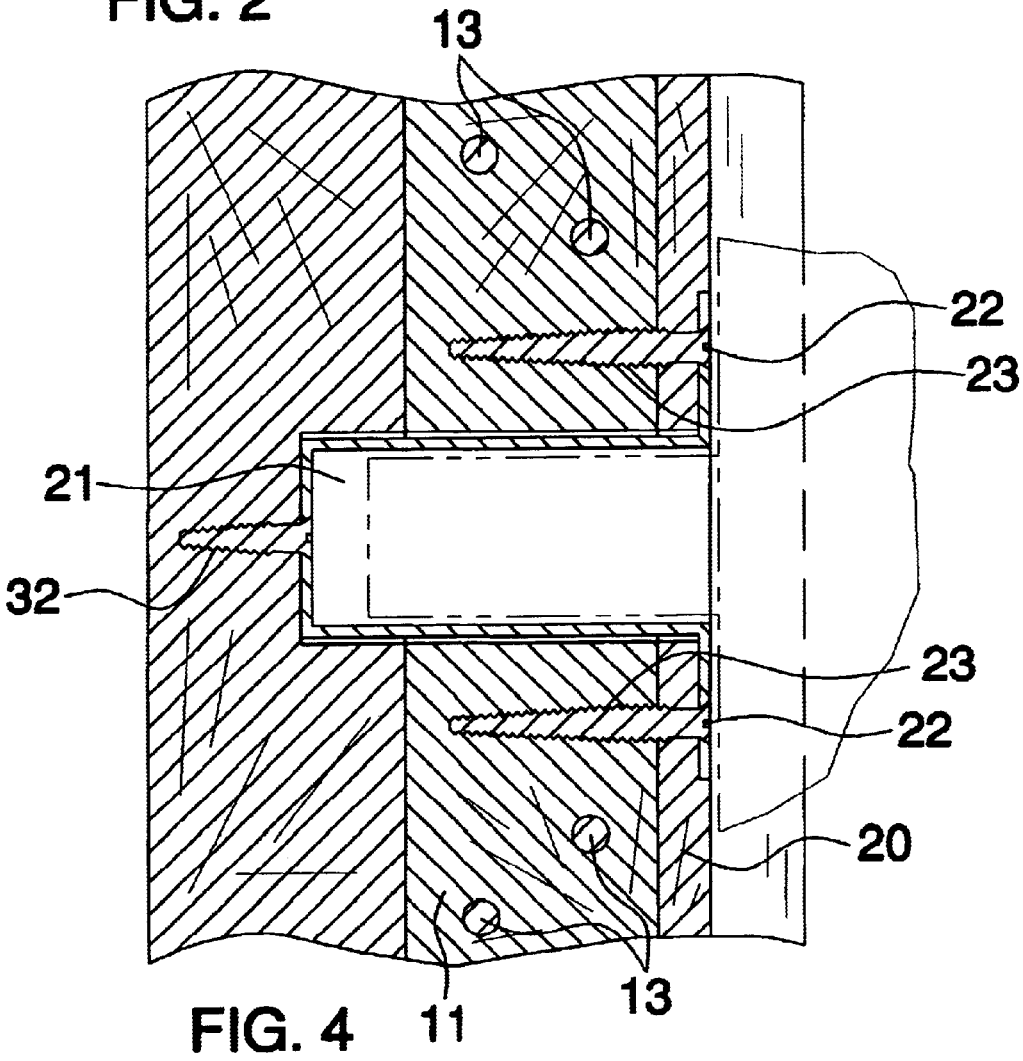
FIG. 4 is an enlarged cross-sectional view taken along line 44 in FIG. 2.

Now referring to FIGS. 1 and 3, the strike plate assembly 10 further has a barrel portion 30 preferably formed from steel and may be formed from other suitable material, as well known in the industry. Such a barrel portion 30 has a substantially cylindrical hollow interior 31, integral with the receiving plate 20, and extending substantially perpendicularly and rearwardly therefrom so that same can be inserted into an opening of a doorjamb and then into an opening formed at a second face of a wall stud.

The barrel portion 30 is spaced from the reinforcement plate 11 and has a longitudinal axis extending substantially perpendicularly to the longitudinal axis of the reinforcement plate 11. The barrel portion 30 receives a dead bolt therein and assists to maintain same in a stable position during operating conditions. The barrel portion 30 includes a rear end portion 33 having an opening therein for receiving a fastening member 32 therethrough, such as a conventional wood screw, to secure the barrel portion 30 to a wall stud, as perhaps best shown in FIG. 3.

Figure 2:
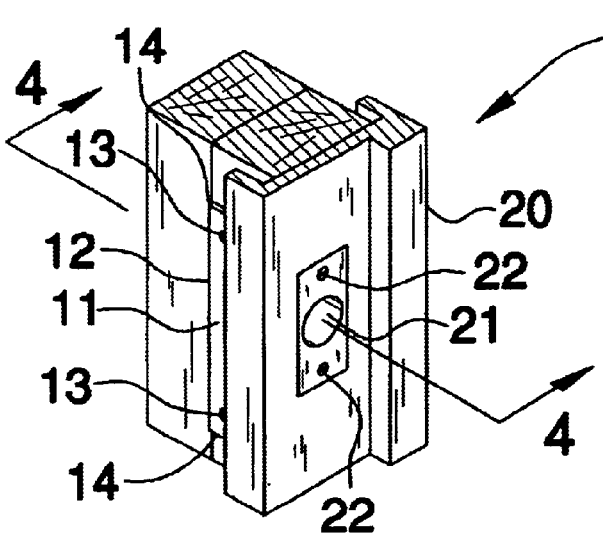
FIG. 2 is a perspective view of FIG. 1.

Now referring to FIG. 2, the receiving plate 20 includes front 24 and rear 25 surfaces, with the rear surface 25 being engageable with a door jamb notch and integral with the barrel portion 30. The cylindrical aperture 21 and the barrel portion 30 are preferably disposed substantially medially between the opposed end portions 26 of the receiving plate 20, as perhaps best shown in FIG. 1.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A strike plate assembly for a dead bolt, said assembly comprising:

an elongated reinforcement plate having a longitudinal axis and a plurality of opposed edge portions equally spaced from the longitudinal axis and extending substantially parallel thereto and along a length of said plate, said reinforcement plate having a plurality of holes disposed at opposed end portions thereof and for receiving a plurality of fastening members therethrough so that said reinforcement plate can be secured to a first face of a wall stud;

a door jamb including a central portion and a plurality of oppositely spaced lip portions integral therewith, one said plurality of lip portions being disposed adjacent an interior of a dwelling and extending orthogonally from said central portion for covering a portion of said reinforcement plate to thereby prevent unauthorized access thereto, another said plurality of lip portions extending orthogonal to said central portion and away from the wall stud, said another lip portion providing a surface for engaging a door when moved to a closed portion;

a receiving plate spaced from said reinforcement plate and having a substantially cylindrical aperture formed therein and for receiving a dead bolt therethrough, said receiving plate having a plurality of holes formed about said cylindrical aperture and for receiving a plurality of fastening members therethrough for securing said receiving plate to a door jamb notch; and a barrel portion having a substantially cylindrical hollow interior and being integral with said receiving plate and extending substantially perpendicularly and rearwardly therefrom so that same can be inserted into an opening of a door jamb and into an opening formed on a second face of a wall stud, said barrel portion receiving a dead bolt therein and assisting to maintain same in a stable position during operating conditions.

2. The assembly of claim 1, wherein said receiving plate includes front and rear surfaces, said rear surface being engageable with a doorjamb notch and integral with said barrel portion.

3. The assembly of claim 1, wherein said receiving plate includes opposed end portions, said cylindrical aperture and said barrel portion are disposed substantially medially between said opposed end portions.

4. The assembly of claim 1, wherein said barrel portion is spaced from said reinforcement plate and has a longitudinal axis extending substantially perpendicularly to the longitudinal axis of said reinforcement plate.

5. The assembly of claim 1, wherein said barrel portion and said receiving plate are formed from steel.

6. The assembly of claim 1, wherein said reinforcement plate is formed from steel.

7. The assembly of claim 1, wherein said barrel portion includes a rear end portion having an opening therein and for receiving a fastening member therethrough to thereby secure said barrel portion to a wall stud.

8. A strike plate assembly for a dead bolt, said assembly comprising:

an elongated reinforcement plate having a longitudinal axis and a plurality of opposed edge portions equally spaced from the longitudinal axis and extending substantially parallel thereto and along a length of said plate, said reinforcement plate having a plurality of holes disposed at opposed end portions thereof and for receiving a plurality of fastening members therethrough so that said reinforcement plate can be secured to a first face of a wall stud;

a door jamb including a central portion and a plurality of oppositely spaced lip portions integral therewith, one said plurality of lip portions being disposed adjacent an interior of a dwelling and extending orthogonally from said central portion for covering a portion of said reinforcement plate to thereby prevent unauthorized access thereto, another said plurality of lip portions extending orthogonal to said central portion and away from the wall stud, said another lip portion providing a surface for engaging a door when moved to a closed position;

a receiving plate spaced from said reinforcement plate and having a substantially cylindrical aperture formed therein and for receiving a dead bolt therethrough, said receiving plate having a plurality of holes formed about said cylindrical aperture and for receiving a plurality of fastening members therethrough for securing said receiving plate to a door jamb notch, said receiving plate includes front and rear surfaces, said rear surface being engageable with a door jamb notch and integral with said barrel portion; and a barrel portion having a substantially cylindrical hollow interior and being integral with said receiving plate and extending substantially perpendicularly and rearwardly therefrom so that same can be inserted into an opening of a door jamb and into an opening formed on a second face of a wall stud, said barrel portion receiving a dead bolt therein and assisting to maintain same in a stable position during operating conditions.

9. The assembly of claim 8, wherein said receiving plate includes opposed end portions, said cylindrical aperture and said barrel portion are disposed substantially medially between said opposed end portions.

10. The assembly of claim 8, wherein said barrel portion is spaced from said reinforcement plate and has a longitudinal axis extending substantially perpendicularly to the longitudinal axis of said reinforcement plate.

11. The assembly of claim 8, wherein said barrel portion and said receiving plate are formed from steel.

12. The assembly of claim 8, wherein said reinforcement plate is formed from steel.

13. The assembly of claim 8, wherein said barrel portion includes a rear end portion having an opening therein and for receiving a fastening member therethrough to thereby secure said barrel portion to a wall stud.

14. A strike plate assembly for a dead bolt, said assembly comprising:

an elongated reinforcement plate having a longitudinal axis and a plurality of opposed edge portions equally spaced from the longitudinal axis and extending substantially parallel thereto and along a length of said plate, said reinforcement plate having a plurality of holes disposed at opposed end portions thereof and for receiving a plurality of fastening members therethrough so that said reinforcement plate can be secured to a first face of a wall stud;

a door jamb including a central portion and a plurality of oppositely spaced lip portions integral therewith, one said plurality of lip portions being disposed adjacent an interior of a dwelling and extending orthogonally from said central portion for covering a portion of said reinforcement plate to thereby prevent unauthorized access thereto, another said plurality of lip portions extending orthogonal to said central portion and away from the wall stud, said another lip portion providing a surface for engaging a door when moved to a closed position;

a receiving plate spaced from said reinforcement plate and having a substantially cylindrical aperture formed therein and for receiving a dead bolt therethrough, said receiving plate having a plurality of holes formed about said cylindrical aperture and for receiving a plurality of fastening members therethrough for securing said receiving plate to a doorjamb notch, said receiving plate includes front and rear surfaces, said rear surface being engageable with a doorjamb notch and integral with said barrel portion; and a barrel portion having a substantially cylindrical hollow interior and being integral with said receiving plate and extending substantially perpendicularly and rearwardly therefrom so that same can be inserted into an opening of a doorjamb and into an opening formed on a second face of a wall stud, said barrel portion receiving a dead bolt therein and assisting to maintain same in a stable position during operating conditions, said barrel portion is spaced from said reinforcement plate and has a longitudinal axis extending substantially perpendicularly to the longitudinal axis of said reinforcement plate.

15. The assembly of claim 14, wherein said receiving plate includes opposed end portions, said cylindrical aperture and said barrel portion are disposed substantially medially between said opposed end portions.

16. The assembly of claim 14, wherein said barrel portion and said receiving plate are formed from steel.

17. The assembly of claim 14, wherein said reinforcement plate is formed from steel.

18. The assembly of claim 14, wherein said barrel portion includes a rear end portion having an opening therein and for receiving a fastening member therethrough to thereby secure said barrel portion to a wall stud.

* * * * *